US010596609B2

(12) United States Patent
Huang et al.

(10) Patent No.: US 10,596,609 B2
(45) Date of Patent: Mar. 24, 2020

(54) SPRINGBACK COMPENSATION METHOD FOR ON-LINE REAL-TIME METAL SHEET ROLL BENDING

(71) Applicant: METAL INDUSTRIES RESEARCH & DEVELOPMENT CENTRE, Kaohsiung (TW)

(72) Inventors: Chun-Cheng Huang, Kaohsiung (TW); Chien-Sin Huang, Kaohsiung (TW); Chien-Hung Huang, Kaohsiung (TW)

(73) Assignee: METAL INDUSTRIES RESEARCH & DEVELOPMENT CENTRE, Kaohsiung (TW)

( * ) Notice: Subject to any disclaimer, the term of this patent is extended or adjusted under 35 U.S.C. 154(b) by 602 days.

(21) Appl. No.: 15/375,152

(22) Filed: Dec. 11, 2016

(65) Prior Publication Data

US 2018/0117653 A1 May 3, 2018

(30) Foreign Application Priority Data

Nov. 1, 2016 (TW) ..... 105135372 A

(51) Int. Cl.

| | |
|---|---|
| ***B21B 38/02*** | (2006.01) |
| ***B21D 5/08*** | (2006.01) |
| ***B21B 37/00*** | (2006.01) |
| ***B21B 39/16*** | (2006.01) |
| ***B21B 1/22*** | (2006.01) |

(52) U.S. Cl.

CPC ..... *B21B 39/16* (2013.01); *B21B 1/22* (2013.01); *B21B 37/00* (2013.01); *B21B 38/02* (2013.01); *B21D 5/08* (2013.01)

(58) Field of Classification Search

CPC ..... B21B 38/02; B21B 38/04; B21B 39/16

See application file for complete search history.

(56) References Cited

U.S. PATENT DOCUMENTS

2015/0251234 A1* 9/2015 Daimaru ..... B21D 5/083 72/181
2016/0023256 A1* 1/2016 Li ..... B21D 5/08 72/234

FOREIGN PATENT DOCUMENTS

| | | | |
|---|---|---|---|
| CN | 201862666 | U | 6/2011 |
| CN | 202207723 | U | 5/2012 |
| CN | 105013895 | A | 11/2015 |
| JP | 2002346634 | A | 12/2002 |
| TW | 200824813 | A | 6/2008 |

(Continued)

*Primary Examiner* — Pradeep C Battula

(74) *Attorney, Agent, or Firm* — CKC & Partners Co., LLC

(57) ABSTRACT

An springback compensation method for on-line real-time metal sheet roll bending includes the steps of using multiple rollers to bend a continuous metal sheet of multiple sections having different materials or different thickness respectively; using a first position sensor to individually measure springback angles of the multiple sections of the bent metal sheet, and feeding back to a programmable logic controller; using the programmable controller to control a bending roller to compensate the multiple sections of the bent metal sheet respectively; using a second position sensor to individually measure compensated angles of the multiple sections of the bent metal sheet; and comparing a difference between the compensated angles and standard angles of the multiple sections of the bent metal sheet after compensating bending.

8 Claims, 3 Drawing Sheets

(56) References Cited

FOREIGN PATENT DOCUMENTS

| | | |
|---|---|---|
| TW | I321501 B | 3/2010 |
| TW | M425007 | 3/2012 |

* cited by examiner

SPRINGBACK COMPENSATION METHOD FOR ON-LINE REAL-TIME METAL SHEET ROLL BENDING

RELATED APPLICATION

This application claims priority to Taiwan Application Serial Number 105135372, filed Nov. 1, 2016, which is herein incorporated by reference.

BACKGROUND

Field of Invention

The present invention relates to a method for roll bending a metal sheet. More particularly, the present invention relates to a springback compensation method for on-line real-time metal sheet roll bending.

Description of Related Art

At present, the springback bending compensation method can only be applied in roll bending a continuous metal sheet of a uniform cross-section and the same material, and cannot be applied in roll bending a continuous metal sheet of dissimilar materials and/or different thicknesses.

For example, the method disclosed in Taiwan Patent No. M425007 and I321501 can only be applied in roll bending a continuous metal sheet of a uniform cross-section and the same material, and cannot be applied in roll bending a continuous metal sheet of dissimilar materials and/or different thicknesses.

When the continuous metal sheet of dissimilar materials and/or different thicknesses is treated by multiple process system and not real-time springback compensation, the processing cost of the metal sheet is increased.

In view of the above-described problems, it is an urgent need to provide a springback compensation method for on-line real-time metal sheet roll bending.

SUMMARY

The present invention provides a springback compensation method for on-line real-time metal sheet roll bending to deal with the above-described problems in the prior art.

In accordance with an object of the present invention, a springback compensation method for on-line real-time metal sheet roll bending includes the steps of (a) using multiple rollers to bend a continuous metal sheet of first, second and third sections having different materials or different thickness respectively; (b) using a first position sensor to individually measure springback angles of the first, second, and third sections of the bent metal sheet, and feeding back to a programmable logic controller; (c) using the programmable controller to control a bending roller to compensate the first, second and third sections of the bent metal sheet respectively; (d) using a second position sensor to individually measure compensated angles of the first, second and third sections of the bent metal sheet; and (e) comparing a difference between the compensated angles and standard angles of the first, second and third sections of the bent metal sheet after compensating bending.

In accordance with another embodiment, the springback compensation method further includes the step of repeating step (b), step (c) and step (d) when a difference exists between the compensated angles and standard angles of the first, second and third sections of the bent metal sheet in step (e).

In accordance with another embodiment, the springback compensation method further includes the step of ending the compensating bending when no difference exists between the compensated angles and standard angles of the first, second and third sections of the bent metal sheet in step (e).

In accordance with another embodiment, the second section is a welding section sandwiched between the first and third sections.

In accordance with another embodiment, the second section is a thickness-transition section sandwiched between the first and third sections.

In accordance with an object of the present invention, a springback compensation method for on-line real-time metal sheet roll bending includes the steps of (a) using multiple rollers to bend a continuous metal sheet of multiple sections having different materials or different thickness respectively; (b) using a first position sensor to individually measure springback angles of the multiple sections of the bent metal sheet, and feeding back to a programmable logic controller; (c) using the programmable controller to control a bending roller to compensate the multiple sections of the bent metal sheet respectively; (d) using a second position sensor to individually measure compensated angles of the multiple sections of the bent metal sheet; and (e) comparing a difference between the compensated angles and standard angles of the multiple sections of the bent metal sheet after compensating bending.

In accordance with another embodiment, the springback compensation method further includes the step of repeating step (b), step (c) and step (d) when a difference exists between the compensated angles and standard angles of the multiple sections of the bent metal sheet in step (e).

In accordance with another embodiment, the springback compensation method further includes the step of ending the compensating bending when no difference exists between the compensated angles and standard angles of the multiple sections of the bent metal sheet in step (e).

Thus, the springback compensation system and method disclosed herein can rapidly and low-costly solve the problem that "a single metal sheet of different thickness", "a single metal sheet of different metals welded to form a continuous one", or "a single metal sheet of different thicknesses and different metals welded to form a continuous one" is roll bent but not immediately online compensated.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
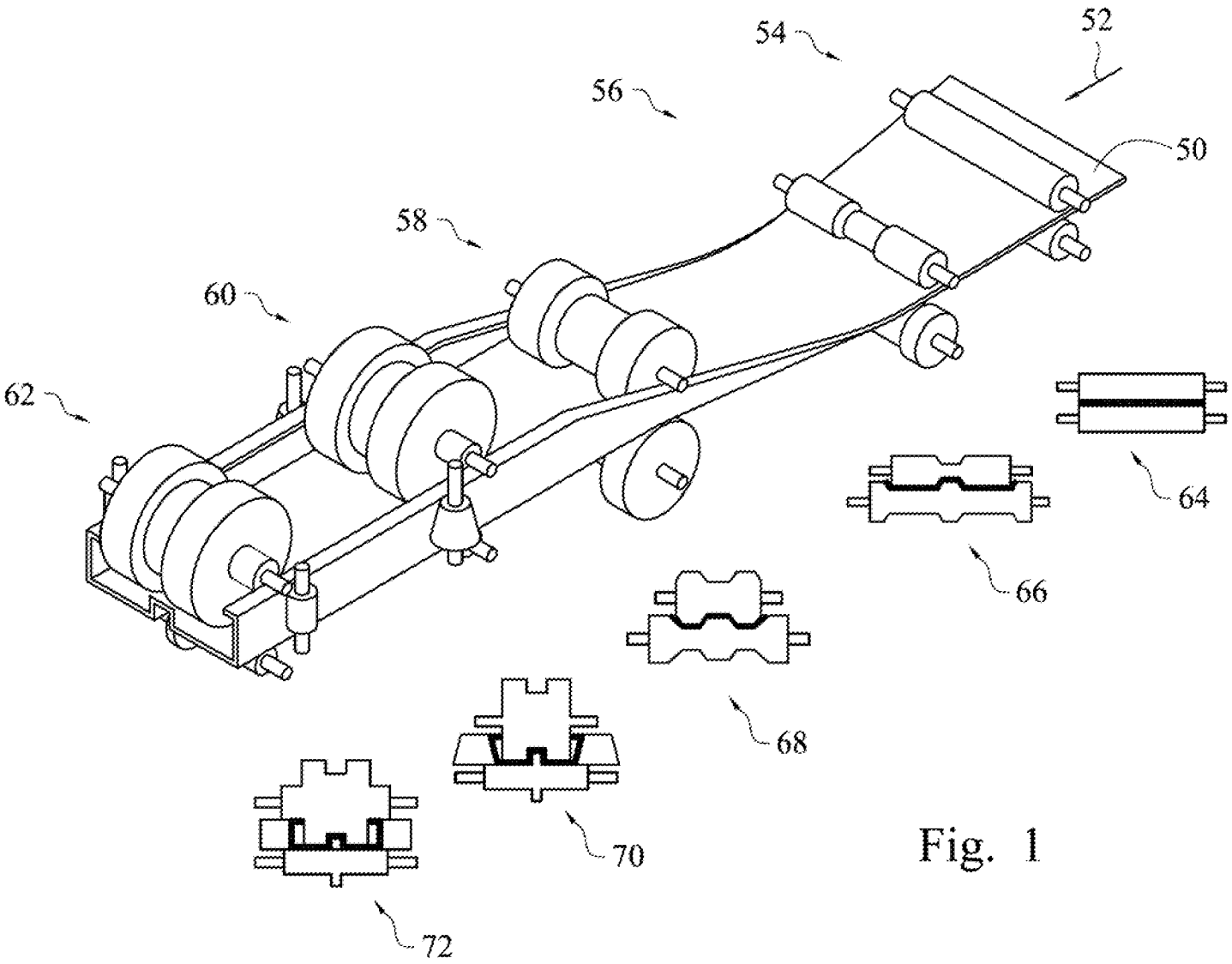
FIG. 1 illustrates a perspective view of a metal sheet roll bending system according to one embodiment of this invention.

Reference will now be made in detail to the present embodiments of the invention, examples of which are illustrated in the accompanying drawings. Wherever possible, the same reference numbers are used in the drawings and the description to refer to the same or like parts.

In order to solve the above-mentioned problems, the present invention provides a springback compensation method for a on-line, real-time roll bending applied to a continuous compensation having different thicknesses, metal welding of different metals or different thicknesses with a low cost and an immediate compensation after the roll bending.

Referring to FIG. 1, which illustrates a perspective view of a metal sheet roll bending system according to one embodiment of this invention. This system includes multiple roller sets (54, 56, 58, 60, 62), e.g. two or more rollers are grouped, to roll bend a continuous metal sheet 50 along a direction 52. The side views (64, 66, 68, 70, 72) are corresponding to the roller sets (54, 56, 58, 60, 62) respectively. The roller set 54 is used to roll the metal sheet 50 flattened while the remaining roll sets (56, 58, 60, 620) are used to roll the metal sheet 50 to a desired shape or a desired cross-section along the direction 52.

After the metal sheet 50 is rolled and bent, the metal sheet 50 may have different degrees of springback due to the difference in the metal materials or mechanical properties thereof, and a subsequent compensation step is required to ensure that the metal sheet 50 is bent to a desired standard shape or cross-section.

Figure 2:
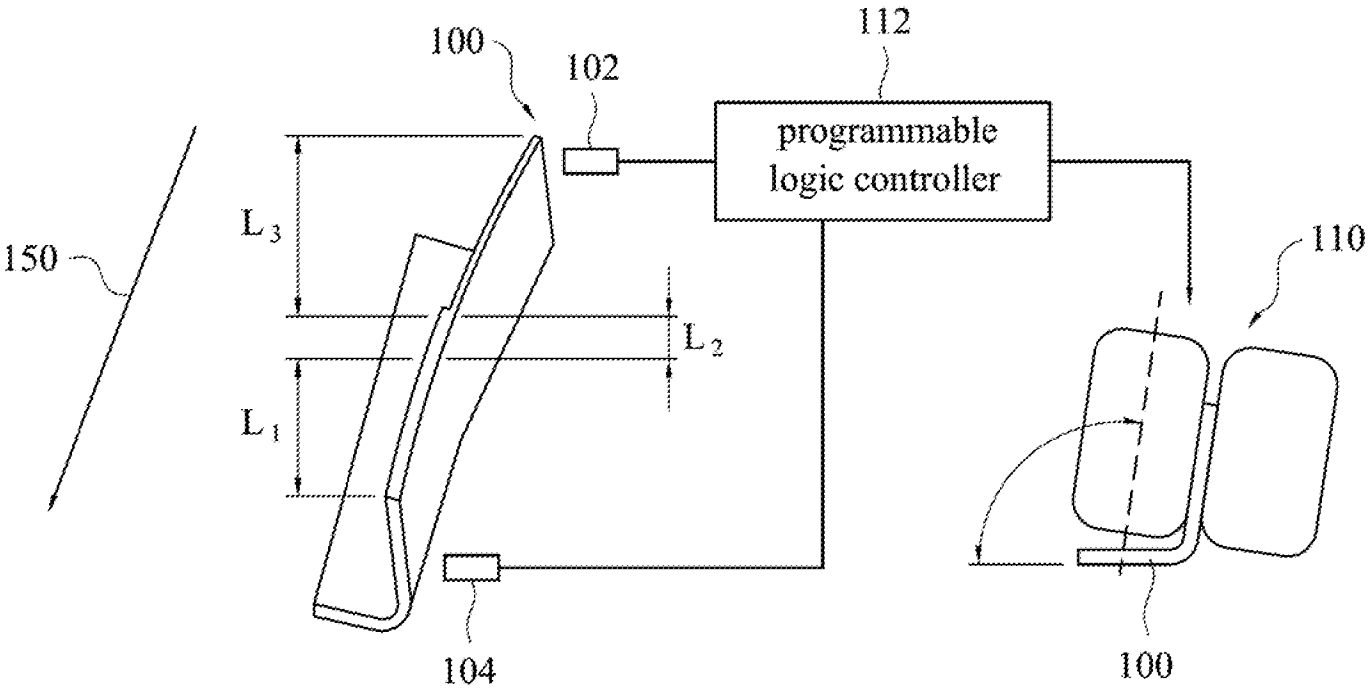
FIG. 2 illustrates a perspective view of an springback compensation system for on-line, real-time metal sheet roll bending according to one embodiment of this invention.
Figure 3:
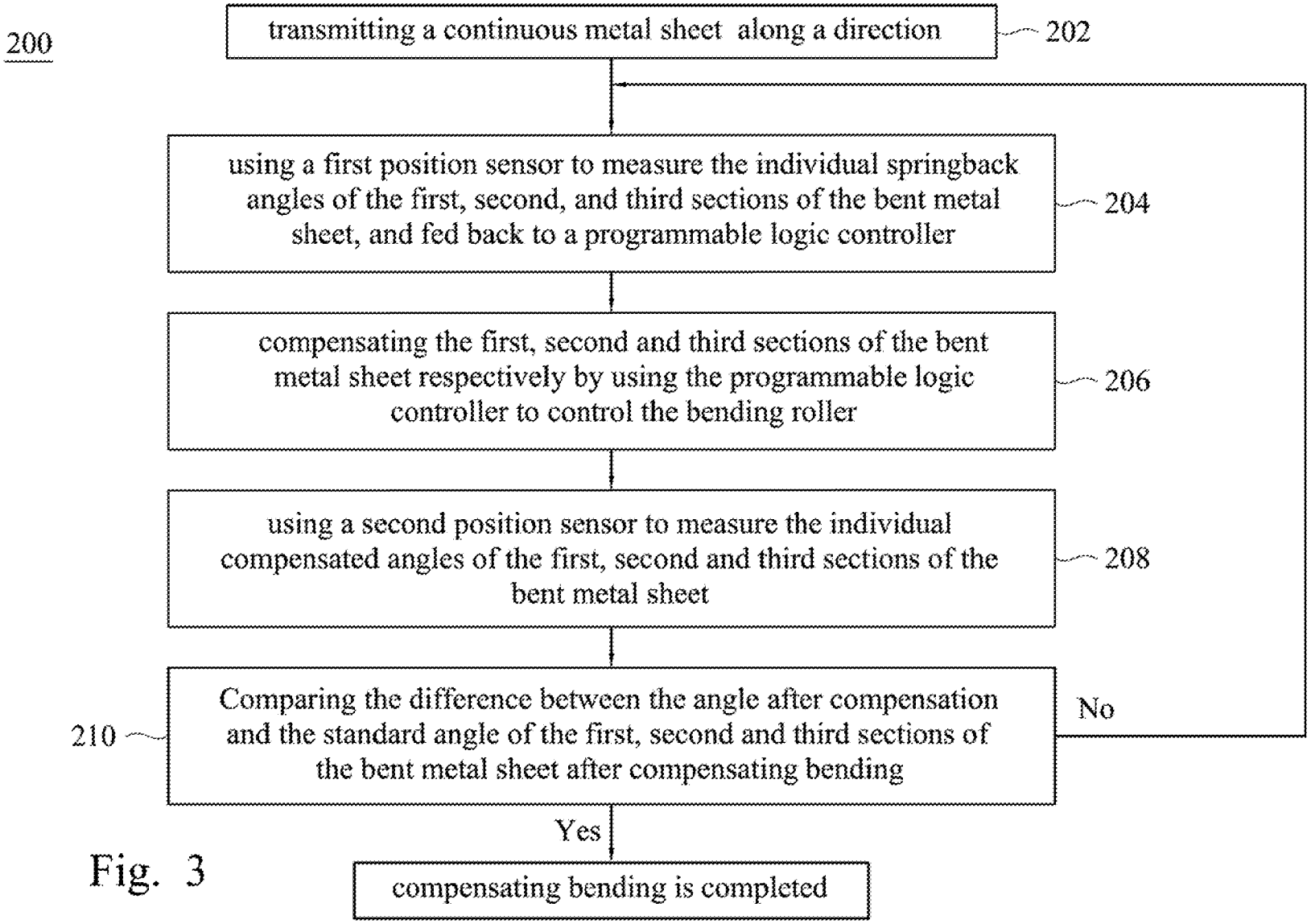
FIG. 3 illustrates a flowchart of a springback compensation method for on-line, real-time roll bending according to one embodiment of this invention.

Referring to both FIG. 2 and FIG. 3, FIG. 2 illustrates a perspective view of a springback compensation system for on-line, real-time metal sheet roll bending according to one embodiment of this invention; and FIG. 3 illustrates a flowchart of a springback compensation method 200 for on-line, real-time roll bending according to one embodiment of this invention.

In step 202, the metal sheet 100 is bent along a direction 150 of the production line, and followed by a springback compensation. The metal sheet 100 may be a single metal sheet of different thickness, a single metal sheet of different metals welded to form a continuous one, or a single metal sheet of different thicknesses and different metals welded to form a continuous one in addition to a single metal sheet of an uniform thickness or the same material. When the metal sheet 100 is not a single metal sheet of a uniform thickness or the same material, the metal sheet 100 can be divided into three sections (for example, the first, second and third sections) to facilitate an accurate compensation.

Taking FIG. 2 as an example, the first section L1 may be a thicker sheet, the third section L3 may be a thinner sheet, and the second section L2 may be a thickness-transition section sandwiched between the first and third sections (L1, L3), which will produce different degrees of springback from the first or third sections. Therefore, the second section L2 is compensated independently to be conducive to accurate the springback compensation. Of course, it is not excluded that the metal sheet 100 may be divided into two sections for springback compensation. In other embodiments, the metal sheet 100 may a metal sheet of different metal sheets welded to form a continuous one, or a metal sheet of different thicknesses and different metal welded to form a continuous one. Thus, the first section may be a sheet of the first metal, the third section may be a sheet of the second metal, and the second section may be a welding section sandwiched between the first and third sections, which will produce different degrees of springback from the first or third sections. Therefore, the second section is compensated independently to be conducive to accurate the springback compensation. Alternatively, the first section may be a thicker sheet of the first metal, the third section may be a thinner sheet of the second metal, and the second section may be a welding section sandwiched between the first and third sections (also a thickness-transition section), which will produce different degrees of springback from the first or third sections. Therefore, the second section is compensated independently to be conducive to accurate the springback compensation.

In step 204, the first position sensor 102 is used to individually measure springback angles of the first, second, and third sections (L1, L2, L3) of the continuous metal sheet 100 after roll bending the metal sheet 100 along the direction 150, and fed back to the programmable logic controller 112. In other embodiments, it is not excluded that using a position sensor to individually measure springback angles of the two successive sections or four or more successive sections of the continuous metal sheet 100 after roll bending (e.g., three thicknesses or three kinds of metals welded to form a continuous one).

In step 206, the programmable logic controller 112 may be used to control the bending roller(s) 110 (as illustrated in FIG. 2) after obtaining the respective springback angle signals for the first, second and third sections (L1, L2, L3) of the continuous metal sheet 100, and the first, second, and third sections of the bent continuous metal sheet 100 are compensated for bending according to the above-described springback angles.

In step 208, a second position sensor 104 is used to measure the respective compensated angles of the first, second, and third sections (L1, L2, L3) of the compensated bent metal sheet 100. And then comparing a difference between the compensated angles and standard angles of the first, second and third sections (L1, L2, L3) of the bent metal sheet 100 after compensating bending.

In step 210, the programmable logic controller 112 determines which one of the following two conditions is met. When the individual compensated angles of the first, second and third sections (L1, L2, L3) measured in step 208 differ from the standard angles, steps (204, 206, 208) are repeated (i.e., a subsequent springback compensation is conducted). When the individual compensated angles of the first, second, and third sections (L1, L2, L3) measured in step 208 meet the standard angles, the springback compensation is completed.

In sum, the springback compensation system and method disclosed herein can rapidly and low-costly solve the problem that "a single metal sheet of different thickness", "a single metal sheet of different metals welded to form a continuous one", or "a single metal sheet of different thicknesses and different metals welded to form a continuous one" is roll bent but not immediately online compensated.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A springback compensation method for the on-line real-time metal sheet roll bending which is used to compensatingly bend a continuous metal sheet of multiple sections having different materials or different thicknesses to predetermined standard angles respectively, wherein the springback compensation method comprises:

(a) using multiple rollers to bend the continuous metal sheet of the multiple sections having different materials or different thicknesses respectively;

(b) using a first position sensor to individually measure springback angles of the multiple sections of the bent metal sheet, and feeding back to a programmable logic controller;

(c) using the programmable controller to control a bending roller to compensatingly bend the multiple sections of the bent metal sheet respectively;

(d) using a second position sensor to individually measure compensated angles of the multiple sections of the bent metal sheet; and (e) comparing a difference between the compensated angles and the predetermined standard angles of the multiple sections of the bent metal sheet after compensating bending.

2. The springback compensation method of claim 1 further comprising:

repeating step (b), step (c) and step (d) when a difference exists between the compensated angles and the predetermined standard angles of the multiple sections of the bent metal sheet in step (e).

3. The springback compensation method of claim 1 further comprising:

ending the compensating bending when no difference exists between the compensated angles and the predetermined standard angles of the multiple sections of the bent metal sheet in step (e).

4. A springback compensation method for on-line real-time metal sheet roll bending which is used to compensatingly bend a continuous metal sheet of first, second and third sections having different materials or different thicknesses to predetermined standard angles respectively, wherein the springback compensation method comprises:

(a) using multiple rollers to bend the continuous metal sheet of the first, second and third sections having different materials or different thicknesses respectively;

(b) using a first position sensor to individually measure springback angles of the first, second, and third sections of the bent metal sheet, and feeding back to a programmable logic controller;

(c) using the programmable controller to control a bending roller to compensatingly bend the first, second and third sections of the bent metal sheet respectively;

(d) using a second position sensor to individually measure compensated angles of the first, second and third sections of the bent metal sheet; and (e) comparing a difference between the compensated angles and the predetermined standard angles of the first, second and third sections of the bent metal sheet after compensating bending.

5. The springback compensation method of claim 4 further comprising:

repeating step (b), step (c) and step (d) when a difference exists between the compensated angles and the predetermined standard angles of the first, second and third sections of the bent metal sheet in step (e).

6. The springback compensation method of claim 4 further comprising:

ending the compensating bending when no difference exists between the compensated angles and the predetermined standard angles of the first, second and third sections of the bent metal sheet in step (e).

7. The springback compensation method of claim 4, wherein the second section is a welding section sandwiched between the first and third sections.

8. The springback compensation method of claim 4, wherein the second section is a thickness-transition section sandwiched between the first and third sections.

* * * * *